US007743686B2

(12) United States Patent
Farrell

(10) Patent No.: US 7,743,686 B2
(45) Date of Patent: Jun. 29, 2010

(54) AIR BRAKE SLACK CHECK TOOL

(76) Inventor: Terry C. Farrell, 12682 Walnut Dr., Conneaut Lake, PA (US) 16316

( * ) Notice: Subject to any disclaimer, the term of this patent is extended or adjusted under 35 U.S.C. 154(b) by 223 days.

(21) Appl. No.: 11/609,021

(22) Filed: Dec. 11, 2006

(65) Prior Publication Data

US 2008/0134443 A1 Jun. 12, 2008

(51) Int. Cl.
*B25B 7/04* (2006.01)
*B25F 1/00* (2006.01)

(52) U.S. Cl. ..... 81/414; 81/407; 81/484

(58) Field of Classification Search ..... 81/358, 81/385, 407, 413–415, 418, 420, 484; D8/52
See application file for complete search history.

(56) References Cited

U.S. PATENT DOCUMENTS

| | | | | | |
|---|---|---|---|---|---|
| 754,740 | A * | 3/1904 | Bordewisch et al. | ..... | 81/382 |
| 826,153 | A * | 7/1906 | De Groff | ..... | 81/412 |
| 960,070 | A * | 5/1910 | Brown | ..... | 81/331 |
| 1,051,921 | A * | 2/1913 | Schlehr | ..... | 81/13 |
| 2,592,927 | A * | 4/1952 | Manning | ..... | 81/414 |
| 2,640,381 | A * | 6/1953 | Manning | ..... | 81/414 |
| 3,635,107 | A * | 1/1972 | Schmidt | ..... | 81/367 |
| 3,739,664 | A * | 6/1973 | Swanstrom, Jr. | ..... | 81/414 |
| 4,603,607 | A * | 8/1986 | Schaffner, Jr. | ..... | 81/414 |
| 4,726,265 | A * | 2/1988 | Reich | ..... | 81/411 |
| D296,750 | S * | 7/1988 | Hamatani | ..... | D8/14 |
| 4,890,519 | A * | 1/1990 | Le Duc | ..... | 81/328 |
| 5,134,908 | A * | 8/1992 | Fisher | ..... | 81/414 |
| D343,779 | S * | 2/1994 | Imhoff | ..... | D8/52 |
| 5,816,120 | A * | 10/1998 | Kilgore | ..... | 81/414 |
| 6,892,609 | B2 * | 5/2005 | Kuo | ..... | 81/413 |
| D523,723 | S * | 6/2006 | Walker | ..... | D8/107 |
| 7,100,480 | B2 * | 9/2006 | Engvall et al. | ..... | 81/413 |
| 7,234,377 | B2 * | 6/2007 | Wolfson | ..... | 81/415 |
| 2005/0217439 | A1 * | 10/2005 | Macor | ..... | 81/413 |

* cited by examiner

*Primary Examiner*—David B Thomas
(74) *Attorney, Agent, or Firm*—Lackenbach Siegel, LLP

(57) ABSTRACT

A pliers has specifically configured elongate jaws of about rectilinear construction with multiple position adjustability to variously operatively engage a plurality of slack adjustment services of diverse commercial air brakes to check the slack.

10 Claims, 5 Drawing Sheets

AIR BRAKE SLACK CHECK TOOL

BACKGROUND OF THE INVENTION

1. Field of the Invention

This invention relates to tools for checking the slack on an automotive air brake. This invention more particularly relates to tools for checking the slack in air brake automotive slack adjusters.

2. Discussion of the Background and Prior Art

A typical foundation air brake used on each wheel, or wheel-pair, of large vehicles such as trucks and buses includes an air chamber rigidly mounted on a non-rotating portion of an axle structure near one of the wheels. A piston within the chamber is moved in one direction by compressed air controlled by a valve operated by the driver of the vehicle to apply the brakes by means of a push rod attached to the piston and connected by a clevis to a lever, called a slack adjuster, mounted on one end of a cam shaft. This movement of the lever transmits torque through the camshaft to rotate an S-shaped cam, or S-cam, rigidly mounted on the other end of the shaft. The S-cam transmits the force through cam-follower rollers supported at the ends of brake shoes to force the brake shoes apart and the brake pads mounted on them against the brake drum to brake the vehicle.

The brake shoes are set to move a certain minimum distance before the pads touch the drums, and this distance constitutes slack in the movement of the slack adjuster lever. As the brake drum and the pads wear, the lever has to move farther to apply the brakes, which increases the range of slack movement. This freedom of motion must be limited so that it does not exceed a certain maximum amount, and for that reason the lever includes means for adjusting its angular setting on the camshaft relative to the orientation of the S-cam. The slack adjuster is not directly affixed to the camshaft but is rotatably mounted on a worm gear that has internal spines mounted on spines on the end of the camshaft to prevent the gear from rotating relative to the shaft. The lever can rotate on the worm gear only to a limited extent within a range determined by the engagement of gear teeth on the outer surface of the gear with a worm mounted in a fixed location within the slack adjuster lever. The worm is rotatable about its own axis, which is perpendicular to the axis of the cam shaft, and it has a polygonal head, which is usually hexagonal but is square on some slack adjusters, and is somewhat accessible from outside the slack adjuster to permit the worm to be rotated on its axis by a socket wrench. Excess slack is taken up by rotating the head to adjust the angle of the lever to the proper position to cause the S-cam to begin to apply pressure to the roller followers after the outer end of the push rod extending from the air chamber has moved only a short distance, typically between ½" and ¾" from the position it occupies when the piston is not under pressure from compressed air.

Other slack adjusters are referred to as self-adjusting or automatic because they have sensors that detect the amount of slack and are connected to actuating means in the slack adjusting lever to rotate the worm to take up excess slack. However, even the automatic slack adjusters have provision for some manual check.

The slack in each brake of a vehicle so equipped needs to be checked regularly to be sure that the brake shoes apply balanced pressure on the drums so that they can bring the vehicle to a halt without causing it to swerve or skid as it stops. In organizations that operate fleets of vehicles having air brakes, mechanics are required to inspect the brakes on a regular schedule, but in addition, the drivers are also supposed to check the slack adjusters at the beginning of each day's trip.

Recent state and federal regulations, such as the Department of Transportation's 1198 edict, mandate that all truck drivers must be able to measure the slack in the air brakes of the vehicles they own, operate or drive. Thus the air brakes must be checked daily, and certainly before each trip, to determine if the slack of each air brake assembly is within or exceeds the safe working maximum limits.

In the field relating to air brake slack check tools, it is generally known to provide a tool having fixedly spaced engagement members, which members are positioned for engagement of different but a limited number of slack check surfaces. One such tool is disclosure is U.S. Des. 296,750, granted Jul. 19, 1988 to Hamatani (the "Hamatani tool"). The Hamatani tool required two hands to be operable, one hand engages the handle and the other hand adjusts and sets the position using a wing nut. The Hamatani tool relies on the wing nut to hold the set position when the tool was in use. A present widely used tool, quite similar to the Hamatani tool construction, is the Brake Slack Check OTC 5052 tool, commercially available from OTC a division of SPX Corporation, Owatonna, Minn. (the "OTC tool"). The OTC tool provides a four position construction. The OTC tool, like the Hamatani tool, requires two hands to be operable, and provides a limited range of operable positions. The OTC tool also generally requires a two-person operation; a first person operates the tool while a second person in the cab applies force to the brake to permit the first person to use the tool to check the clearance or slack.

The air brake slack check the art desires a tool, which readily provides sufficient gripping and leverage forces for a broad range of slack adjuster surfaces of diverse models of trucks and buses, and yet is practical in design and construction. The air brake slack check art further desires a tool, as aforesaid, which eliminates the number of hands and operators, and yet provides the necessary slack check leverage. The present invention provides a solution to the foregoing slack check art requirements and needs.

In the field related to pliers, it is generally known to provide pliers that are adjustable. Adjustable pliers are disclosed in U.S. Pat. No. 6,892,609, granted May 17, 2005 to Kuo, U.S. Pat. No. 4,603,607 granted Aug. 5, 1986 to Schaffner et al, U.S. Pat. No. 5,134,908, granted Aug. 4, 1992 to Fisher, and U.S. Pat. No. 4,890,519 granted Jul. 2, 1990 to Le Duc.

SUMMARY OF THE PRESENT INVENTION

The automotive air brake slack check tool includes first and second members having respective handles and respective elongate jaws integral with the respective handles, and means for adjustably pivotably connecting the first and second members so that the jaws are adjustably disposed in a plurality of operable positions, so that the jaws grippingly engage differently sized oppositely disposed air brake slack adjustor check surfaces, with a sufficient gripping force and leverage exerted in each position so that a one-person slack check is effected in each position, without the need for a second person in the cab to actuate the brake. The slack check tool is adjustable from a fully closed position to 7 operable positions. Each jaw has respective teeth, with the respective teeth in facing parallel disposition in each operable position, and the respective teeth being in angular disposition in the fully closed position. The elongated jaws, in each respective position, permit the slack adjustor check surfaces to be moved at least about up to 1 inch without the need for brake actuation. That is, one person checks the air brake slack without the need for a second person to actuate the brake.

Each elongate jaw has a rectangular sectional configuration and a width to height ratio of about 2:1. This construction was found to be operable for a broad range of slack adjustor check surfaces, and exert the necessary leverage to move the air brake adjustor the requiste slack check distance, without flexure of the jaws.

BRIEF DESCRIPTIONS OF THE DRAWINGS

DESCRIPTION OF THE INVENTION

Figure 1:
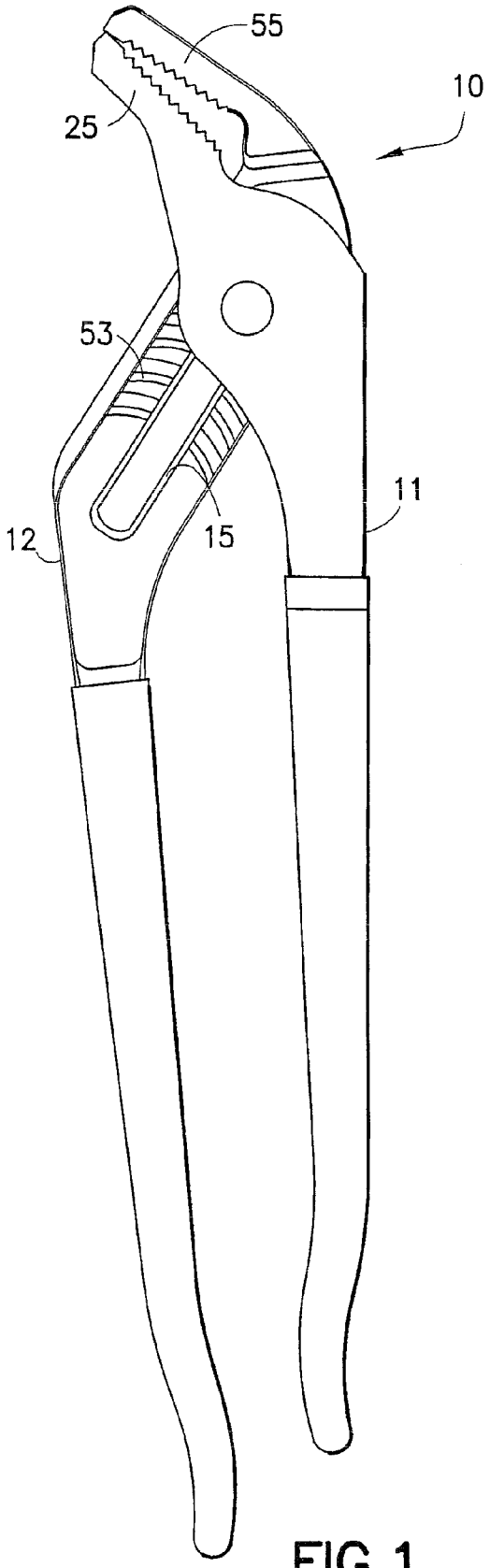
FIG. 1 is a front elevational view of the tool of the present invention.
Figure 2:
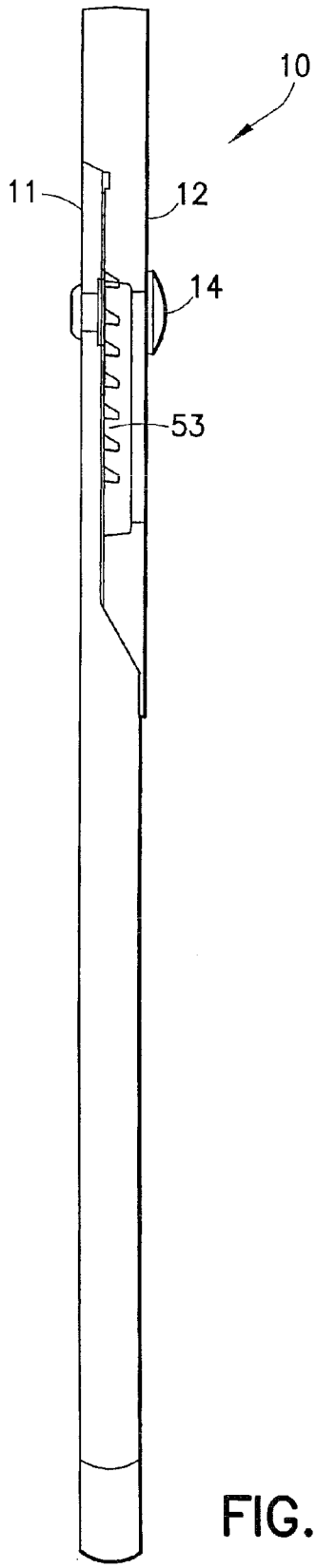
FIG. 2 is a right rule elevational view of the tool of FIG.1.

Referring to the FIGS., there is shown air brake slack check tool of the present invention 10. Tool 10 includes two members 11 and 12. Members 11 and 12 are pivotably connected by adjustable pivot assembly 13. Adjustable pivot assembly 13 includes pivot pin 14, elongate or race slot 15 that slidably rotatably receives pin 14, and an arcuate ridge or element 16. Member 11 is formed with jaw 25, and member 12 is formed with jaw 55. Arcuate ridge16 slidably operably engages each respective arcuate slot or groove 53 so as to provide 7 operable positions. Pivot pin 14 is rotatably disposed in through hole 21.

Adjustable pivot pliers construction are in well known in the pliers art, as shown and described in U.S. in the field related to pliers, it is generally known to provide pliers that are adjustable. Adjustable pliers are disclosed in U.S. Pat. No. 6,892,609, granted May 17, 2005 to Kuo, U.S. Pat. No. 4,603,607 granted Aug. 5, 1986 to Schaffner et al, U.S. Pat. No. 5,134,908, granted Aug. 4, 1992 to Fisher, and U.S. Pat. No. 4,890,519 granted Jan. 2, 1990 to Le Duc, which disclosures are incorporated herein by reference thereto. One commercially available adjustable pliers is the 440 model by Channellock®, Meadville, Pa. 16335.

Figure 6:
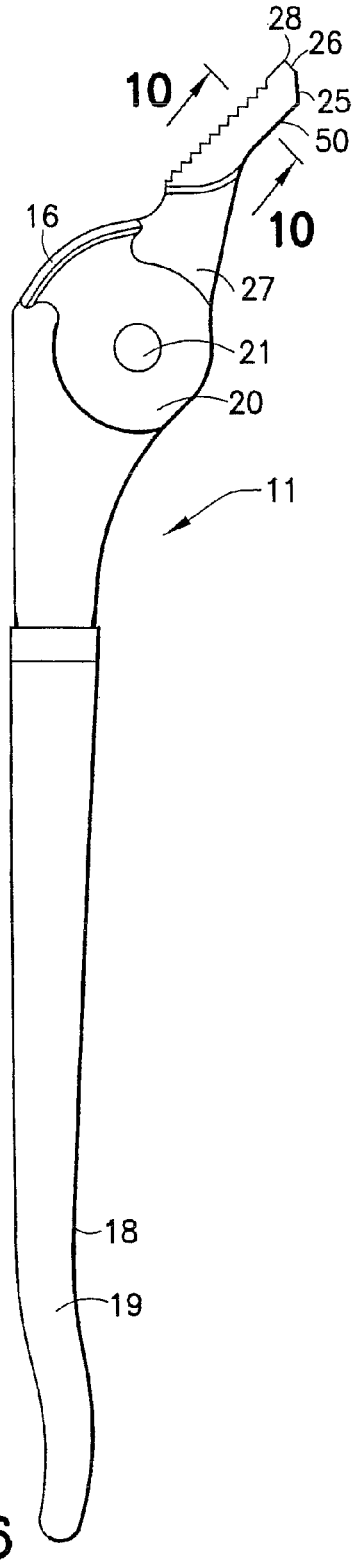
FIG. 6 is a rear elevational view of the opposed member of the tool of FIG. 1.
Figure 10:
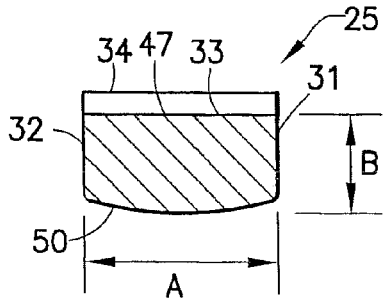
FIG. 10 is a greatly enlarged sectional view taken along line 10-10 of FIG. 6.

Referring specifically to FIG. 6, member 11 includes handle 18 having thermoplastic grip cover 19, intermediate portion 20 with transverse through hole 21 for slidably receiving pivot pin 14, and jaw 25. Jaw 25 is formed with intermediate portion 20 having arcuate ridge element 16. Jaw 25 is of elongate 27 are integral and contiguous with intermediate portion 20. Distal end 26 includes a distal planar end surface 28 and angularly disposed contiguous planar surface 29, and a rectilinear about planar, surface 50, as best shown in FIGS. 1, 6 and 10. Jaw 25 includes about planar outer surface 50, oppositely disposed planar sides 31 and 32 and inner side 33 having teeth 34. The rectilinear sectional configuration of Jaw 25 has a width A and height B, wherein width A is substantially greater than the height B (FIG. 10). The sectional width A is defined as the distance between planar sides 31 and 32. The sectional height B is defined as the distance between outer surface 50 and the base 47 of teeth.

Figure 5:
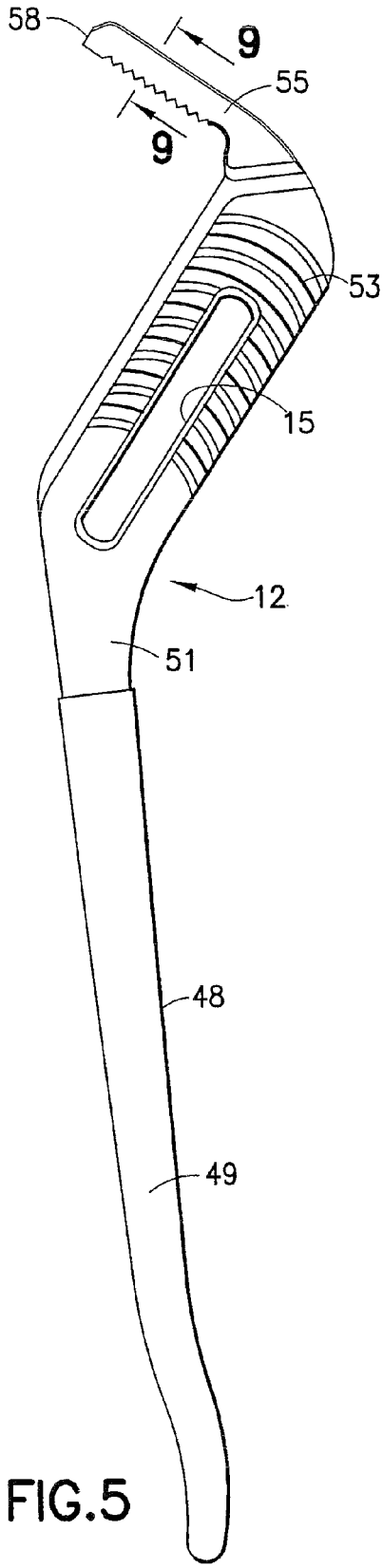
FIG. 5 is a front elevational view of one member of the tool of FIG. 1.
Figure 9:
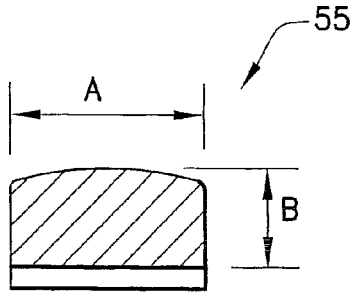
FIG. 9 is a greatly enlarged sectional view taken along line 9-9 of FIG. 5.

Referring to FIGS. 1,5 and 9, member 12 is of one-piece integral hardened 1080 steel construction. Member 12 includes handle 48 having thermoplastic grip cover 49, and intermediate portion 51 formed with slot or race 15 for slidably and rotatably receiving pin 14. A plurality of arcuate grooves e.g. 53 are formed-intermediate portion 51. Each groove is sized to removably slidably receive arcuate ridge or element 16. Member 12 includes jaw 55. Jaw 55, like jaw 25, has a rectilinear sectional configuration wherein the corresponding width A to height is about 2:1. Referring specifically to FIG. 9, there is shown the cross section of jaw 55. Jaw 55 includes outer planar surface 60, opposed planar surfaces 61 and 62, teeth 64 and teeth base 63. The width A to height B ratio is likewise about 2:1. this manner of construction, the user selectively positions in ridge or element 16 in a respective groove so position as to provide an adjusted position for the jaws 25 and 55 to provide gripping engage a corresponding specifically size air brake slack adjuster, and exert the requisite force with that flexure of the jaws.

Figure 3:
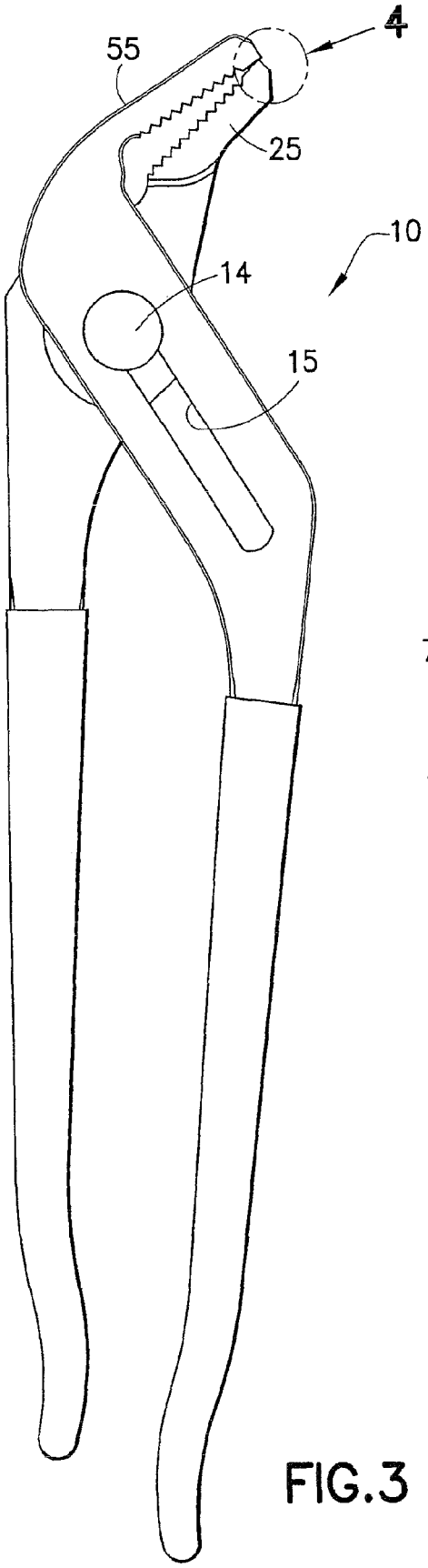
FIG. 3 is a rear elevational view of the tool of FIG. 1.
Figure 4:
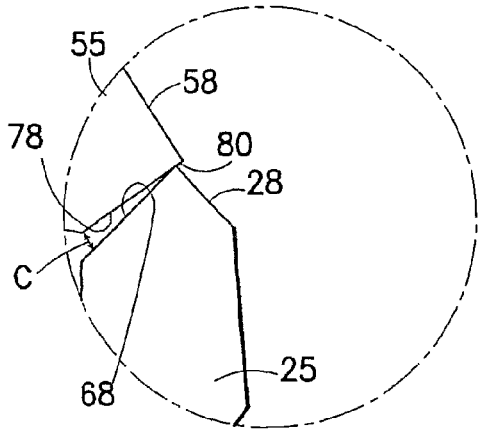
FIG. 4 is a greatly enlarged partial view of the distal end of the tool as shown in FIG. 3.

Referring specifically to FIGS. 3 and 4, the air brake slack check tool 10 is shown in the fully closed position. In this position the respective distal ends 28 and 58 of jaws 25 and 55 are in contacting engagement at contact point 86, and respective inner planar surfaces 68 and 78 substend on acute angle C.

Figure 7:
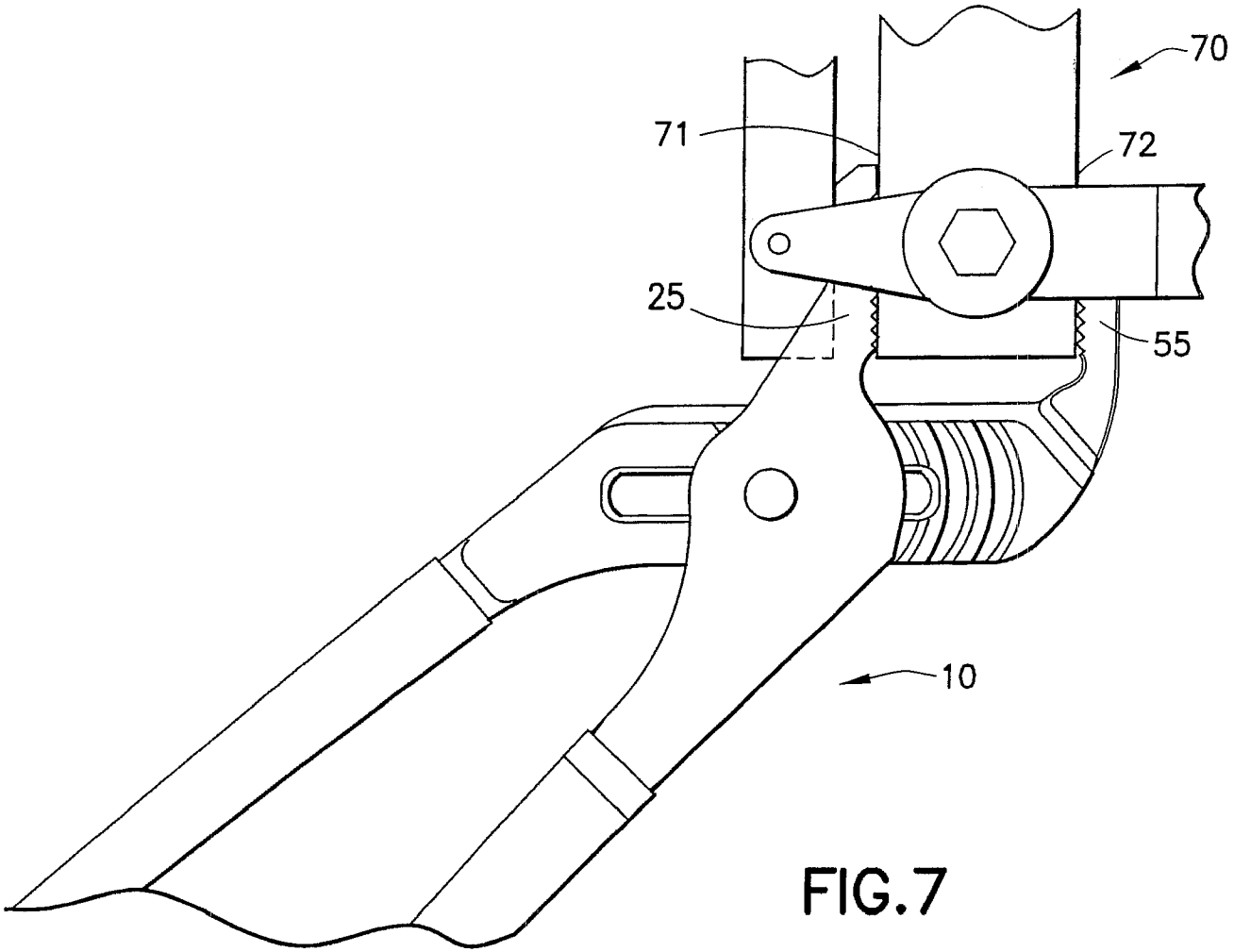
FIG. 7 is a front view of the tool of FIG. 1 in an adjusted operational position.
Figure 8:
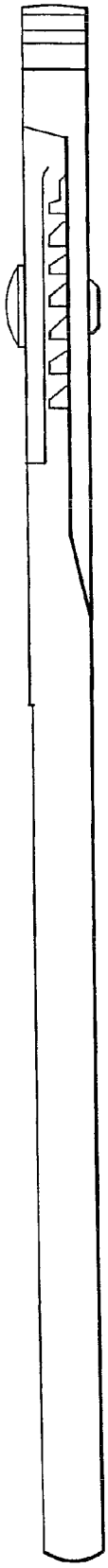
FIG. 8 is a left side elevational view of tool of FIG. 1.

Referring specifically to FIG. 7, there is shown air brake slack check tool 10 in operable engagement with air brake slack adjuster 70. Jaws 25 and 55 are in parallel disposition and the respective teeth are grippingly engaged with oppositely disposed planar surfaces 71 and 72 of slack adjuster 70. In this manner of construction, the user in gripping handles 18 and 48 is able to exert a sufficient force to move adjuster 70 up to about 1 inch and thereby check the slack without the need for an operator in the cab to press the brake pedal. The specifically configured jaws 25 and 55 fully engage surfaces 71 and 72 during the slack check without flexure of the jaws.

It has been found that by providing a jaw of hardened steel wherein the width A is substantially greater than height B, and specifically in 2:1 ratio a substantial force may be exerted without flexure of the jaw as required by ASME B107.23 standard. It is noted that prior art heavy duty prior pliers were directed to at least one of-the jaws having a concave beefed-up, outwardly extending position. The present pliers eliminates that construction.

The tool of the present invention is useful for a broad range of U.S. and foreign made trucks and buses, including without limitation, Mack®, Freightliner®, and Kensworth®. The tool of the present invention is operable with a broad range of S-cam slack adjustors.

The invention has been described with reference to specific embodiments and materials and components, but it will be obvious to those skilled in the air brake slack check art that the embodiments, materials, and components may be modified without departing from the true scope of this invention.

What is claimed is:

1. An automotive air brake slack check tool comprising:

first and second members, each said member comprises and respective first and second handles and respective elongate first and second jaws integral with the respective handles, and means for adjustably pivotably adjustably connecting the first member with the second member, from a fully closed position to a plurality of operable positions with said jaws disposed in about parallel disposition in each said operable position, each said jaw comprises respective teeth, said jaws comprise respective inner surfaces, each said inner surface comprises teeth and an adjacent distally disposed planar surface, said first and second jaws further comprise respective distally disposed edges immediately adjacent the respective first and second planar surfaces; and in the fully closed position the first jaw edge is more proximately disposed than the second jaw edge, and the planar surfaces subtend an acute angle with the first jaw edge contactingly engaged with the second jaw planar surface in the fully closed position at the apex of the acute angle; wherein said first jaw teeth are angularly disposed and subtend an acute angle in said fully closed position, each said jaw comprises an inner side and an outer side, said inner side comprises said teeth, each respective inner and outer side being disposed in respective planes disposition, said teeth being in about facing parallel position in each said operable position, so that the jaws operably engage air brake slack adjusters and grippingly engage differently sized oppositely disposed air brake slack adjuster surfaces, whereby a sufficient force is exerted in each said operable position for each different air brake slack adjuster so that a one-person slack check is effected in each said operable position, wherein each jaw comprises a cross-section, and each cross-section comprises a width defined as the distance between oppositely disposed front and back sides and a height defined as the distance between the outer side and the inner side, and wherein the width is greater than the height.

2. The air brake slack check tool of claim 1, wherein with the jaws, in each respective operable position, the jaws permit the slack check surfaces to be moved a minimal distance of at least about up to about 1 inch without brake actuation, so that one person checks the air brake slack without the need for a second person in moving the slack check surfaces the minimal distance to actuate the brake.

3. The air brake slack check tool of claim 1, wherein the width to height ratio is about 2:1 at both the distal end and proximate end of each respective jaw.

4. The tool of claim 1, wherein the first jaw comprises a lower jaw and the second jaw comprises an upper jaw.

5. In combination:

(a) an automotive air brake slack check tool comprising:

first and second members, said member comprises the respective first and second handles and respective first and second elongate jaws integral with the respective handles, and means for adjustably pivotably connecting the first member with the second member wherein the jaws are adjustably disposed in a fully closed inoperable position and a plurality of operable positions, said first and second jaws comprise respective inner surfaces, each said inner surface comprises teeth and an adjacent planar surface, said first and second jaws comprise respective distally disposed edges adjacent respective planar surfaces, and in the fully closed position the first jaw edge is more proximately disposed than the second jaw edge, said first jaw edge contactingly engages the second jaw planar surface between the second jaw edge and second jaw teeth in the fully closed position, and the planar surfaces subtend an acute angle in the fully closed position with the first jaw edge at the apex of the acute angle; wherein said first jaw teeth and said second jaw teeth are angularly disposed, each said jaw comprises an inner side and an outer side, each said inner side comprises said respective teeth, each respective inner and outer side being disposed in respective planes disposition, said teeth being in about facing parallel position in each said operable position; and (b) first and second different air brake slack adjusters comprising oppositely disposed differently sized air brake slack check surfaces, whereby the operator causes the jaws to grippingly engage each respective oppositely disposed air brake slack check surfaces and exert a sufficient force in each respective operable position to permit the slack check surfaces to be moved at least about up to 1 inch without brake actuation, wherein each jaw comprises a cross-section and each cross-section comprises a width defined as the distance between the said oppositely disposed front and back planar sides and a height defined as the distance between the outer side and the inner side , and wherein the width is greater than the height.

6. The combination of claim 5, wherein the tool is adjustable to each said operable position.

7. The combination of claim 5, and wherein width to height ratio is about 2:1 at both the distal end and proximate end of each respective jaw.

8. A method for a one-person checking of the slack on different automotive air brakes comprising:

(a) providing first and second air brake slack adjusters; said air brake slack adjusters being differently sized;

(b) providing an automotive air brake slack check tool, said tool comprises an automotive air brake slack check tool comprising:

first and second members, each said member comprises and respective first and second handles and respective elongate first and second jaws integral with the respective handles, and means for adjustably pivotably connecting the first member with the second member, wherein the jaws are adjustably disposed in a plurality of operable positions, said first and second jaws comprise respective inner surfaces, each said inner surface comprises teeth and an adjacent planar surface, said first and second jaws comprise respective distally disposed edges adjacent respective planar surfaces, and in the fully closed position the first jaw edge is more proximately disposed than the second jaw edge, said first jaw edge contactingly engages the second jaw planar surface between the second jaw edge and second jaw teeth in the fully closed position, and the planar surfaces subtend an acute angle in the fully closed position; wherein said first jaw teeth and said second jaw teeth are angularly disposed and subtend an acute angle in said fully closed with the first jaw edge disposed at the apex of the acute angle position, each said jaw comprises an inner side and an outer side, each said jaw inner side comprises respective said teeth, each said jaw inner and outer side being disposed in respective planes disposition, and said teeth being in about facing parallel position in each said operable position;

(c) pivotably moving the members to a first operable position for the first air brake slack adjuster and alternatively pivotably moving the members to a second operable position for the second air brake slack adjuster;

(d) gripping the handles with one hand and alternately grippingly engaging the automotive air brake slack check surfaces of said differently sized first and second air brake slack adjusters with the tool in one of said operable positions for each alternate air brake slack; and (e) moving the slack check surfaces at least about up to one inch without brake actuation; whereby one person checks the first and second air brake slacks without the need for a second person to actuate the respective brakes.

9. The method of claim 8, said first and second air brake slack adjusters comprise S-cam slack adjusters.

10. The method of claim 9, wherein a second person does not actuate the brake when the first person performs steps (c)-(e) for each S-cam slack adjuster.

* * * * *